United States Patent [19]

Cooper

[11] 4,206,955

[45] Jun. 10, 1980

[54] CLOSET STORAGE UNIT

[76] Inventor: Jack M. Cooper, 2471 SW. 122 Court, Miami, Fla. 33175

[21] Appl. No.: 929,928

[22] Filed: Aug. 1, 1978

[51] Int. Cl.[2] ..... A47B 87/00

[52] U.S. Cl. ..... 312/107; 312/108; 108/61; 248/222.2

[58] Field of Search ..... 312/107, 108, 111, 198, 312/257 R, 263; 211/186; 108/61; 248/222.2

[56] References Cited

U.S. PATENT DOCUMENTS

| | | | |
|---|---|---|---|
| 1,055,050 | 3/1913 | Knape | 248/222.2 |
| 1,852,598 | 4/1932 | Vogt | 248/222.2 |
| 2,561,426 | 7/1951 | Stearn et al. | 312/107 |
| 2,620,929 | 12/1952 | Sportsman | 108/61 |
| 2,665,963 | 1/1954 | Wallack | 312/198 |
| 2,721,632 | 10/1955 | Surpierre | 108/61 |
| 3,481,485 | 12/1969 | Hess | 108/61 |
| 3,779,623 | 12/1973 | Motohashi | 312/108 |
| 4,021,089 | 5/1977 | Bush | 312/111 |
| 4,045,103 | 8/1977 | Paolino | 312/198 |
| 4,055,373 | 10/1977 | Andresen et al. | 312/108 |

FOREIGN PATENT DOCUMENTS

| | | | |
|---|---|---|---|
| 927892 | 6/1973 | Canada | 312/107 |
| 2312619 | 3/1973 | Fed. Rep. of Germany | 312/107 |

*Primary Examiner*—Victor N. Sakran

[57] ABSTRACT

A closet storage unit of predetermined height including, a lower frame substantially one-half the height of the unit and a plurality of drawers in said frame and an upper second frame sized to fit on the lower, frame, also substantially one-half the height of the unit, and having a plurality of shelves, and a standard in spaced relation from the stacked frames; adjustable support members in the form of rods and shelving span the frames and standard. A second standard may be provided with shelves and rods extending oppositely from the first mentioned rods and shelves.

1 Claim, 4 Drawing Figures

CLOSET STORAGE UNIT

Field of the Invention

This invention relates to a unit adapted to be installed in a closet to provide increased storage space and organization of materials.

BACKGROUND OF THE INVENTION

As is perhaps well known, many closets contain substantial space but it is quite difficult to arrange materials within a closet because, generally speaking, the space is confined.

This invention is of a closet organizer or closet units which are to be installed within closets. The unit provides a plurality of storage compartments, first in the form of a set of lower drawers in a frame and, second, a set of shelves in a frame, the frames being stackable, and, third, rods or shelves which span the frames, when stacked, and which also includes standards spaced from the stacked frames to support the distal ends or outboard ends of the rods and shelves. The standards are provided in spaced relation from the stacked frames and shelf supports are connected onto the outside surface of the frames and the inside surface of the standards which confront the stacked frames for supporting the rods or shelves in spanning relation of the stacked frames and the standards. In the preferred embodiment described hereinafter, the shelf supports are adjustable heighthwise.

Objects of the Invention

It is an object of this invention to provide an improved storage facility composed of stackable frames sized to be received through a closet door and to be attached together in the form of a unit composed of a lower frame of slidable drawers and an upper frame on top of the lower frame composed of open shelves and wherein a standard is provided in spaced relation at a distance which is convenient for the particular closet within which the unit is installed; and fastener means are provided on the exterior of the frame and on the standard or, in the case of two standards, on the standards, and the standards are spanned by rods or shelves which are supported by fastener means to the frames and on the standards.

In accordance with these and other objects which will become apparent hereinafter, the instant invention will now be described with reference to the accompanying drawings, in which:

DESCRIPTION OF THE PREFERRED EMBODIMENT

Figure 1:
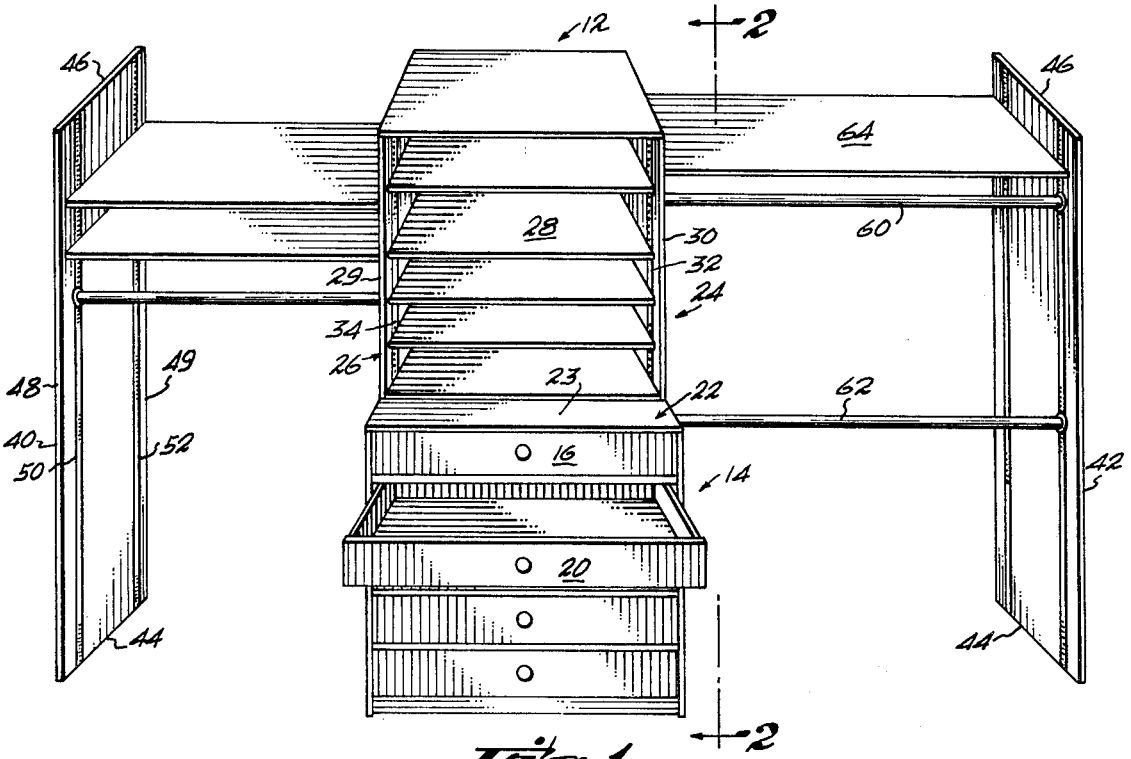
FIG. 1 is a front perspective view illustrating the instant invention and its constituent components.

Referring to the drawings wherein like reference characters designate like or corresponding parts throughout the several views, there is shown a unit generally designated by the numeral 12 which is composed of a lower stack of drawers generally designated by the numeral 14 wherein the drawers, such as 16 are included in a frame 18, one of the drawers, 20, being open. On the top 22 of this lower stack, and spaced rearwardly somewhat, so as to provide an accessible portion of the top 23, there is an upper stack of shelving generally designated by the numeral 24 which includes a frame 26, one of the shelves being designated by the numeral 28. Within the frame 26 and on the side panels 29 and 30 there are arranged pairs of confronting strip members having holes therealong such as 32 and 34. The members of each pair are in opposing relation, one pair being adjacent the front opening and a corresponding pair, not shown, within the interior adjacent the rear panel. It is seen that the lower set of drawers 14 is about one-half the overall height of the unit shown in FIG. 1 and that the upper set of shelves is also about one-half the height, so that the matching components of the set may be installed separately with one on top of the other. In spaced relation from the central unit 12, there are stanchions or standards such as 40 and 42 each comprising an upstanding board having a lower surface such as 44 to rest on the same surface as the set of drawers and an upper end 46 of about the same height as the drawers and shelves of the unit previously described. Extending vertically along the front edge 48 and rear edge 49 there are strips 50 and 52 as described above with holes therealong to accommodate clips, as will be described hereinafter. Similarly, on the exterior surface of the sets of the stacked shelves and the drawers strips are provided and these strips are spanned by rods, such as 60 and 62 and shelves such as 64. For brevity, the left-hand side components are not redescribed; however, it will be noted that several shelves may be utilized if desired.

Figure 2:
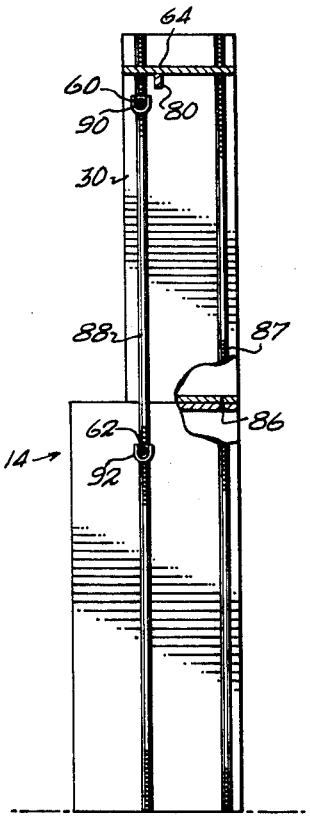
FIG. 2 is a view in cross section taken on the plane indicated by the line 2—2 of FIG. 1 and looking in the direction of the arrows.
Figure 3:
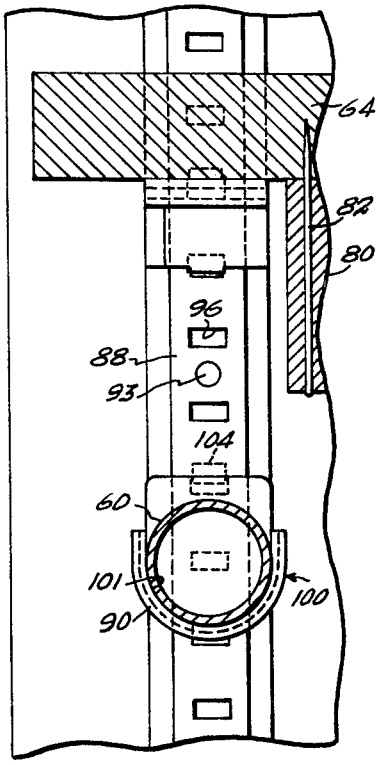
FIG. 3 is an enlarged partial view of the upper left-hand portion of FIG. 2.

As seen in FIG. 2, the shelf 64 may have a depending rigidifying skirt 80 and, as seen in FIG. 3, this skirt 80 is stapled as by the staple means 82 into the shelf 64 and this serves to prevent buckling or sagging of the shelf in the middle under weight. Referring again to FIG. 2, it is seen that in the preferred embodiment screw means 86 are provided to fasten the set of drawers to the set of shelves. With further reference to FIG. 2, the strips 87 and 88 for the shelves and rods are shown as are the clip means 90 and 92, for example.

Figure 4:
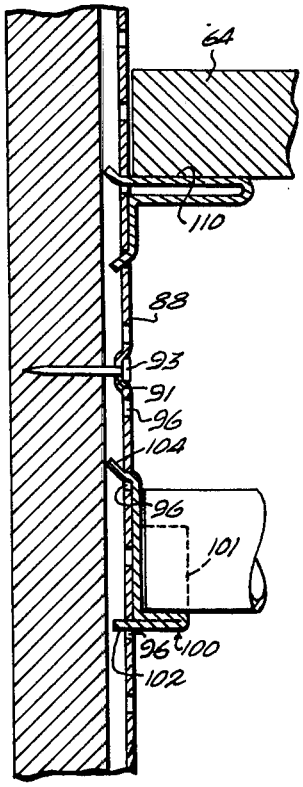
FIG.4 is an enlarged partial view in cross section of FIG. 1.

Referring to FIG. 4, it is seen that each of the strips, such as that designated by the numeral 88, has a plurality of holes such as 91 therealong for fasteners, such as nails 93 and, also, openings such as 96 to accommodate a clip generally designated by the numeral 100 having a foot 102 sized to be received in one of the holes and an upper end 104 sized to be received in an adjacent upper hole. These clips may have a portion 101 sized and adapted to nestle a rod end, such as the rod 60 or, alternatively, the top surface may be flat as at 110 to support the shelf 64.

It is thus seen that there is provided a highly versatile unit which can be readily installed in a closet in a compact manner, so as to greatly enlarge the organization and practical capacity of a closet. It will be noted that by reason of the shelf structure and its frame and the drawer structure and its frame, the unit may be readily installed within a closet without difficulty in moving them separately through the doors of the closet to be stacked within the closet. One unit is installed first and then the other which rests on top of it is installed secondly. The upper unit is preferably sized so as to provide a shelf space on top of the set of drawers in front of the shelves. Also, it will be noted, and as shown at the right of FIG. 1, that a child's clothing may be supported on the lower rod 60 and, later, as the child grows, it may be moved upwardly for gowns or the like. Thus, a highly versatile unit has been provided which is very adapted for use in apartments, condominium units, and other small living space with the result that much of the furniture required to occupy a bedroom may be for practical effect moved into the closet and there utilized in a compact storage arrangement.

It will be recognized that the instant invention has been shown and described in a preferred embodiment but that various alterations may be made within the scope of the instant invention which is therefore not to be limited except as set forth in the claims hereinafter.

What is claimed is:

1. For assembly within a closet, a storage unit and organizer of an overall predetermined height greater than the height of a conventional closet door, and of an overall width greater than the lateral opening of a conventional closet door, comprising:

in combination with a conventional closet, (A) a lower frame comprising rear wall and spaced vertical side walls, said walls being of a common height, each side wall having an inside face and an exterior face and said inside faces being in confronting relation to one another, the distance between the side walls being less than the lateral opening of a conventional closet door; vertically spaced drawer guide means on the confronting inside faces of the side walls, a set of drawers, said guide means being spanned at vertical levels by the drawers of the set for sliding movement in and out in parallel planes perpendicular to the rear wall, said drawers being of a common size, each drawer having a front wall which, when in coplanar relation, define, in combination, a front wall of the lower storage unit, the distance between the front and rear wall of said lower storage unit being of a predetermined dimension; the frame having an upper support surface spanning the walls, said lower frame being of a predetermined height substantially less than the overall predetermined height of a conventional closet door;

(B) an upper frame including spaced side walls and a rear wall, said walls being of a common length and said side walls each having an inside surface and an exterior surface, said inside surface being in confronting relation, said side walls defining a front opening receptacle, said side walls of said upper frame being spaced apart a distance substantially equal to the distance between the side walls of the lower frame, adjustable shelf support means along the inside surfaces of said upper frame side walls, and a set of shelves of common size spanning the upper frame side walls and being vertically spaced from one another and supported on said adjustable support means;

(C) said upper frame being sized to mate in stacked relation on the upper support surface of the lower storage frame with the rear wall of said frames being in a common plane, the height of the upper frame being substantially less than the vertical height of a conventional closet door, the combined height of the stacked frames being equal to or less than the height of the closet, each of said shelves having a front edge and rear edge;

(D) means to secure the frames in stacke relation with said rear walls of said frames in a common plane and a first and second pair of side walls in spaced common planes respectively;

(E) a standard spaced from said stacked upper and lower frames, said standard having a main generally planer surface facing the first pair of side walls of said stacked frames;

(F) adjustable elongate fastener support means extending along the main planar surface of said standard and in confronting relation to the first pair of side walls of the stacked frames, and adjustable elongate fastener support means extending along the exterior faces of the first pair side walls of the stacked frames confronting the standard, and said adjustable fastener means including stations therealong in lateral registry defining a plurality of support planes;

(G) a shelf and a rod spanning said standard and said stacked storage frames supported by said adjustable support means;

(H) a second standard in spaced relation from the stacked frames, said second standard having a main generally planar surface facing the second pair of side walls of the stacked frames and adjustable elongate fastener support means extending along the main surface of the second standard and in confronting relation to the exterior surface of the second pair of side walls of the stacked frame and adjustably elongate fastener support means extending along the exterior surfaces of second pair of side walls of the stacked frames and said elongate fastener means including stations therealong in lateral registry defining a plurality of support planes and a support member spanning said second standard and the second pair of side walls of the stacked frames, and a support member spanning the second standard and the stacked frames on said adjustable support means being adjustable vertically; and, (I) the upper support surface spanning the walls including a front margin comprising an article support surface, said article support surface having an outer edge, said outer edge being spaced from the rear wall of the lower frame a distance greater than the distance between the front edge of the shelves and the rear wall of said upper frame.

* * * * *